US009220647B1

(12) United States Patent
Steinbock et al.

(10) Patent No.: US 9,220,647 B1
(45) Date of Patent: Dec. 29, 2015

(54) RIGID COLLAPSIBLE LITTER

(71) Applicant: Matbock, LLC, Virginia Beach, VA (US)

(72) Inventors: Zachary L. Steinbock, Virginia Beach, VA (US); Sean M. Matson, Virginia Beach, VA (US); R. Scott Foresman, Rancho Santa Margarita, CA (US); Kevin C. Hutchinson, Rancho Santa Margarita, CA (US)

( * ) Notice: Subject to any disclaimer, the term of this patent is extended or adjusted under 35 U.S.C. 154(b) by 0 days.

(21) Appl. No.: 14/143,867

(22) Filed: Dec. 30, 2013

Related U.S. Application Data

(60) Provisional application No. 61/746,979, filed on Dec. 28, 2012.

(51) Int. Cl.
*A61G 1/013* (2006.01)

(52) U.S. Cl.
CPC ..... *A61G 1/013* (2013.01)

(58) Field of Classification Search
CPC ..... A61G 1/013; A61G 1/01; A61G 1/003
USPC ..... 5/89.1, 81.1 T, 625, 110, 111, 114, 116, 5/117, 627; 14/69.5; 59/30
See application file for complete search history.

(56) References Cited

U.S. PATENT DOCUMENTS

| | | | | | |
|---|---|---|---|---|---|
| 320,298 | A * | 6/1885 | Schray | 5/154 |
| 1,004,575 | A * | 10/1911 | Jones | 59/78 |
| 1,281,385 | A * | 10/1918 | Johnson | 5/625 |
| 1,570,014 | A * | 1/1926 | Stevens | 474/228 |
| 2,203,193 | A * | 6/1940 | Ettinger | 5/627 |
| 2,602,345 | A * | 7/1952 | Braumiller | 474/231 |
| 3,336,060 | A * | 8/1967 | Bradford | 403/108 |
| 3,406,410 | A * | 10/1968 | Bidgood | 5/625 |
| 3,586,393 | A * | 6/1971 | Myers | 305/160 |
| 3,750,863 | A * | 8/1973 | Dyczynski | 198/321 |
| 3,883,284 | A * | 5/1975 | De Mets | 425/371 |
| 3,933,164 | A * | 1/1976 | Ness et al. | 135/95 |
| 3,999,229 | A * | 12/1976 | Wyss | 5/99.1 |
| 4,617,689 | A * | 10/1986 | Nelson et al. | 5/400 |
| 4,922,562 | A * | 5/1990 | Allred et al. | 5/627 |
| 5,217,315 | A * | 6/1993 | Rosane | 403/102 |
| 5,555,576 | A * | 9/1996 | Kim | 5/114 |
| 5,988,725 | A * | 11/1999 | Cole | 296/61 |
| 6,463,613 | B1 * | 10/2002 | Thompson | 14/69.5 |
| 6,643,878 | B2 * | 11/2003 | Schmaltz et al. | 14/69.5 |
| 6,722,812 | B1 * | 4/2004 | Carletti et al. | 403/385 |
| 6,928,959 | B1 * | 8/2005 | Trauernicht et al. | 119/847 |
| 7,195,301 | B2 * | 3/2007 | Aulicino | 296/61 |
| 2002/0088065 | A1 * | 7/2002 | Schmaltz et al. | 14/69.5 |
| 2004/0010852 | A1 * | 1/2004 | Bourgraf, Jr. | 5/627 |
| 2013/0098791 | A1 * | 4/2013 | Saunders et al. | 206/326 |
| 2015/0202099 | A1 * | 7/2015 | Sion et al. | A61G 1/013 |

* cited by examiner

*Primary Examiner* — Nicholas Polito
*Assistant Examiner* — Myles Throop
(74) *Attorney, Agent, or Firm* — Middleton Reutlinger

(57) ABSTRACT

The present invention is a rigid collapsible litter having a base and a plurality of collapsible rib members. The rib members are capable of being folded or collapsed in a first direction while remaining rigid in a second direction to support weight placed on the litter.

6 Claims, 15 Drawing Sheets

RIGID COLLAPSIBLE LITTER

CROSS-REFERENCE TO RELATED APPLICATIONS

This application for patent claims the benefit of U.S. Provisional Patent Application No. 61/746,979 entitled "Rigid Collapsible Litter" and filed on Dec. 28, 2012.

FIELD OF THE INVENTION

The present invention relates generally to a litter and more particularly to a collapsible litter having semi-rigid collapsible support members.

BACKGROUND OF THE INVENTION

Prior art litters, also referred to as stretchers, are intended to facilitate the carrying of a passenger, such as an injured person, by one or more other people. Litters are in common use in mass trauma areas such as battlefields to facilitate carrying wounded soldiers to safer locations, or to carry a person who has been injured in a car accident, or to carry a person who has been injured in a hiking accident to a safer location. Such litters generally have a base platform comprised of a flexible material such as canvas, and are long enough and wide enough to secure a person thereto. They also generally have handles or some other feature to facilitate carrying by a group of people.

Prior art litters may also be designed to be rigid and durable. However, rigid construction often requires use of bulky and heavy materials, which can be difficult to carry or transport due to their weight and/or relative inflexibility. Thus, it is often desirable, and attempts have been made, to provide a litter that is collapsible and lighter than traditional litters, and thus easier to carry or transport.

Prior art collapsible litters, however, often have other problems. For example, prior art collapsible litters may be complex, having many parts that are not easily assembled in the field. Such complex litters may cause problems in use because of the time required to assemble the litter and the potential for losing or misplacing parts. Obviously, in battlefield operations every second is critical. Other prior art litters may be less complex and yet lightweight, however, they lack the support and/or rigidity necessary to adequately support a passenger, which is especially problematic if the passenger is injured or unconscious.

Accordingly, based on the foregoing it is readily seen that there is a significant need in the art for a collapsible yet rigid litter for supporting a person, such as a soldier, that is also lightweight and easy to carry that overcomes the problems abundantly apparent in the prior art.

DETAILED DESCRIPTION OF THE PREFERRED EMBODIMENT(S)

Figure 1:
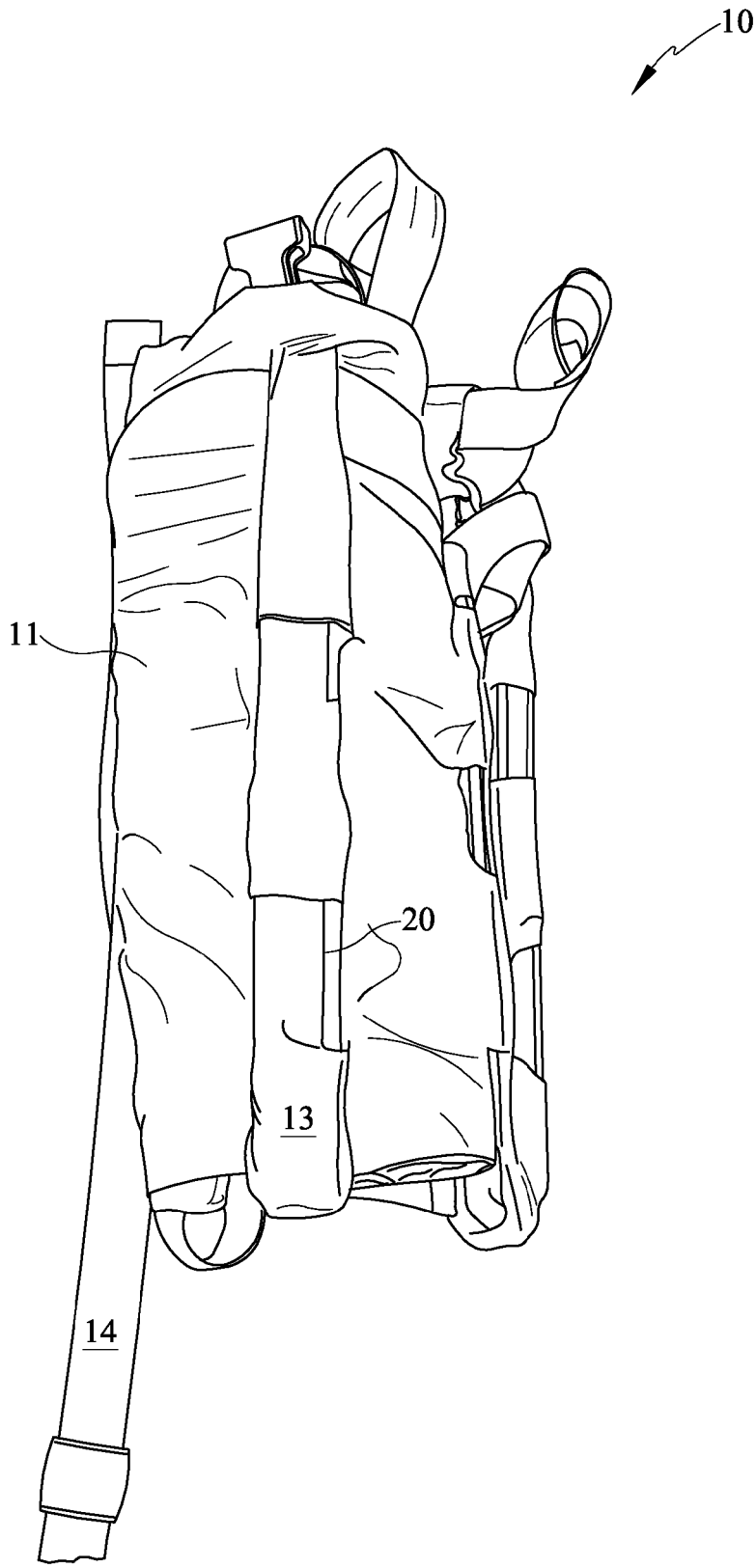
FIG. 1 is a top view of a rigid collapsible litter folded to a compact size in accordance with one embodiment of the present invention.
Figure 2:
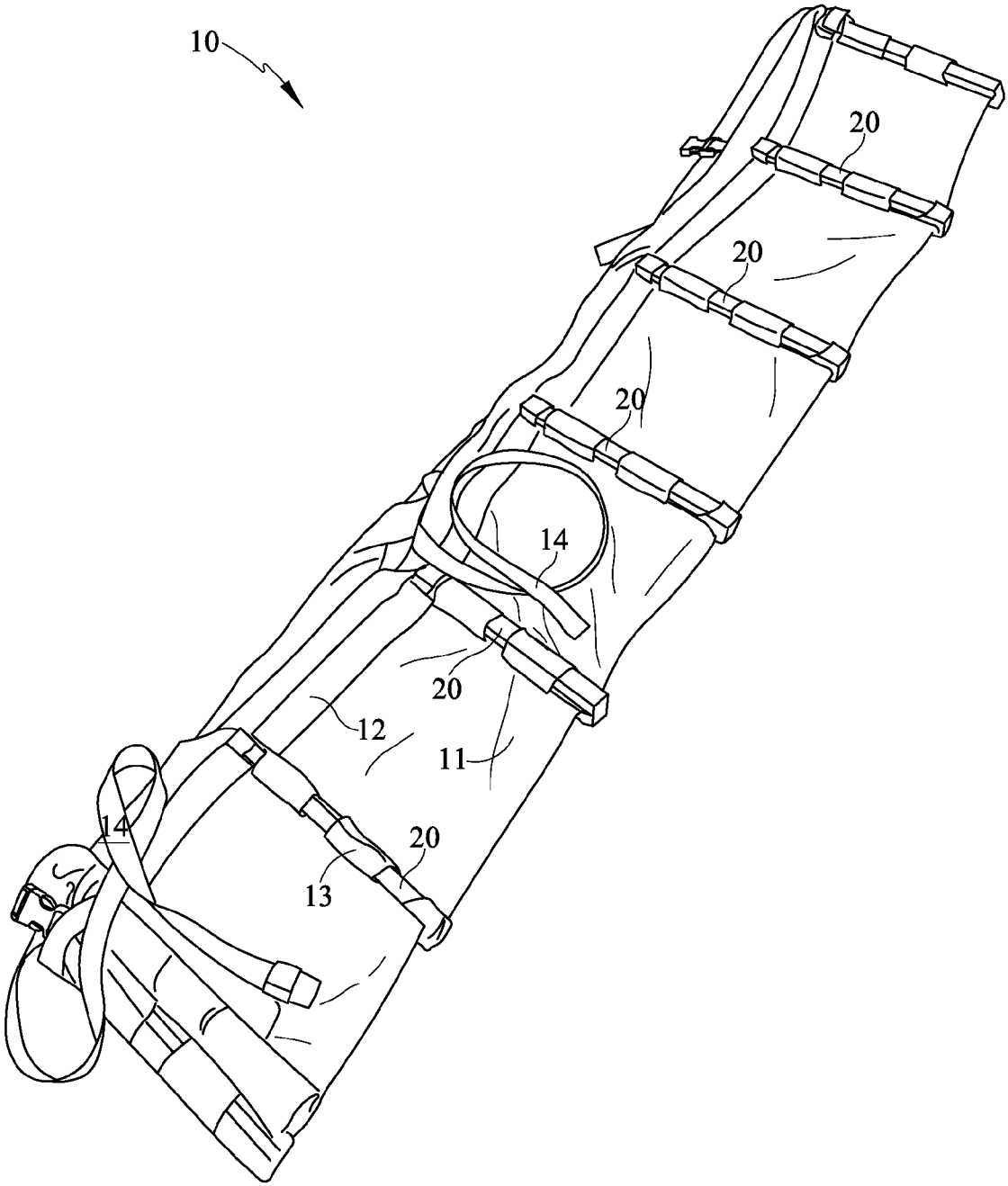
FIG. 2 is a perspective view of a rigid collapsible litter being deployed in accordance with one embodiment of the present invention.
Figure 3:
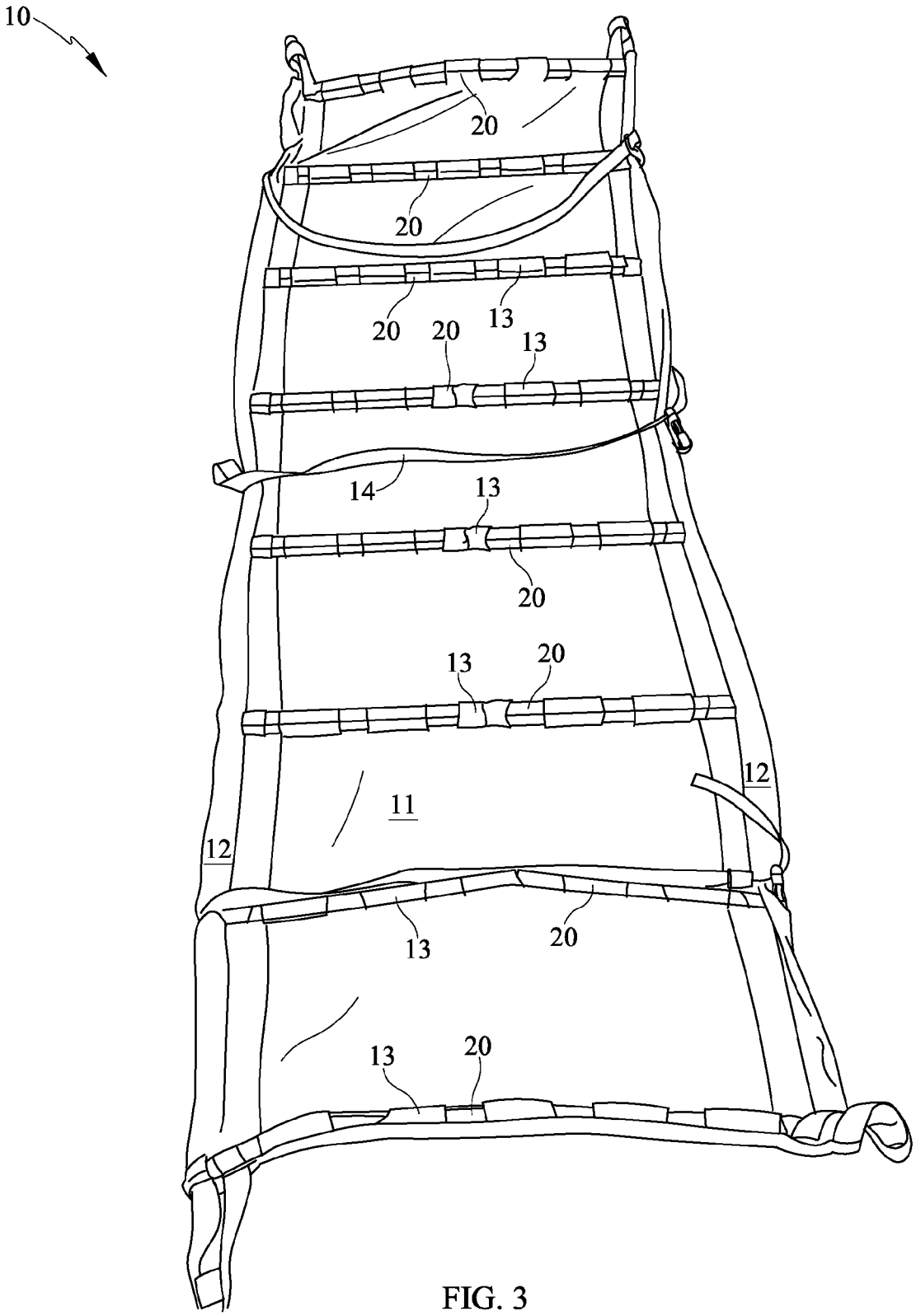
FIG. 3 is a perspective view of a bottom side of a rigid collapsible litter in transition to its deployed form in accordance with one embodiment of the present invention.
Figure 4:
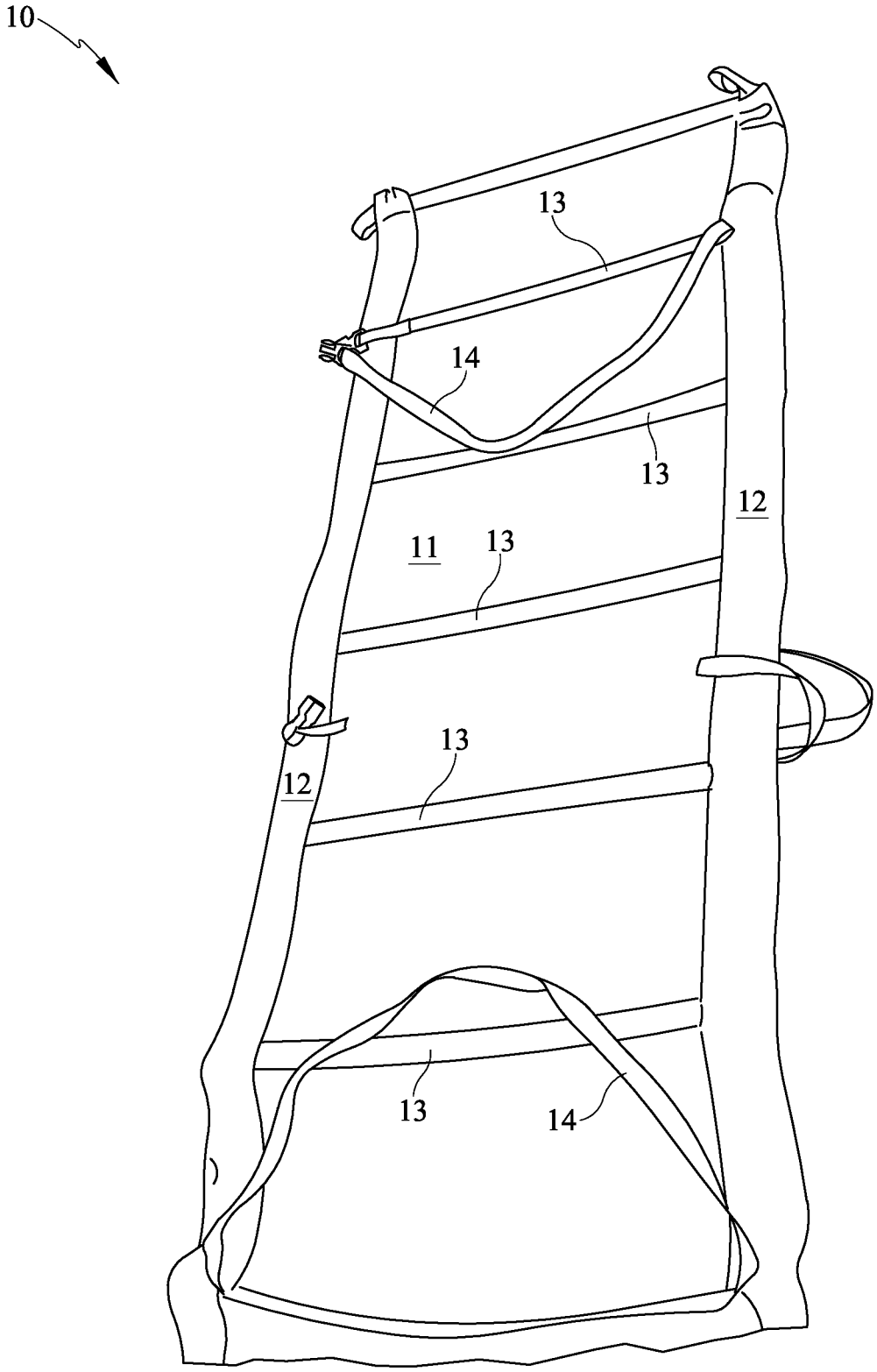
FIG. 4 is a perspective view of a top side of a rigid collapsible litter in transition to its deployed form in accordance with one embodiment of the present invention.
Figure 5:
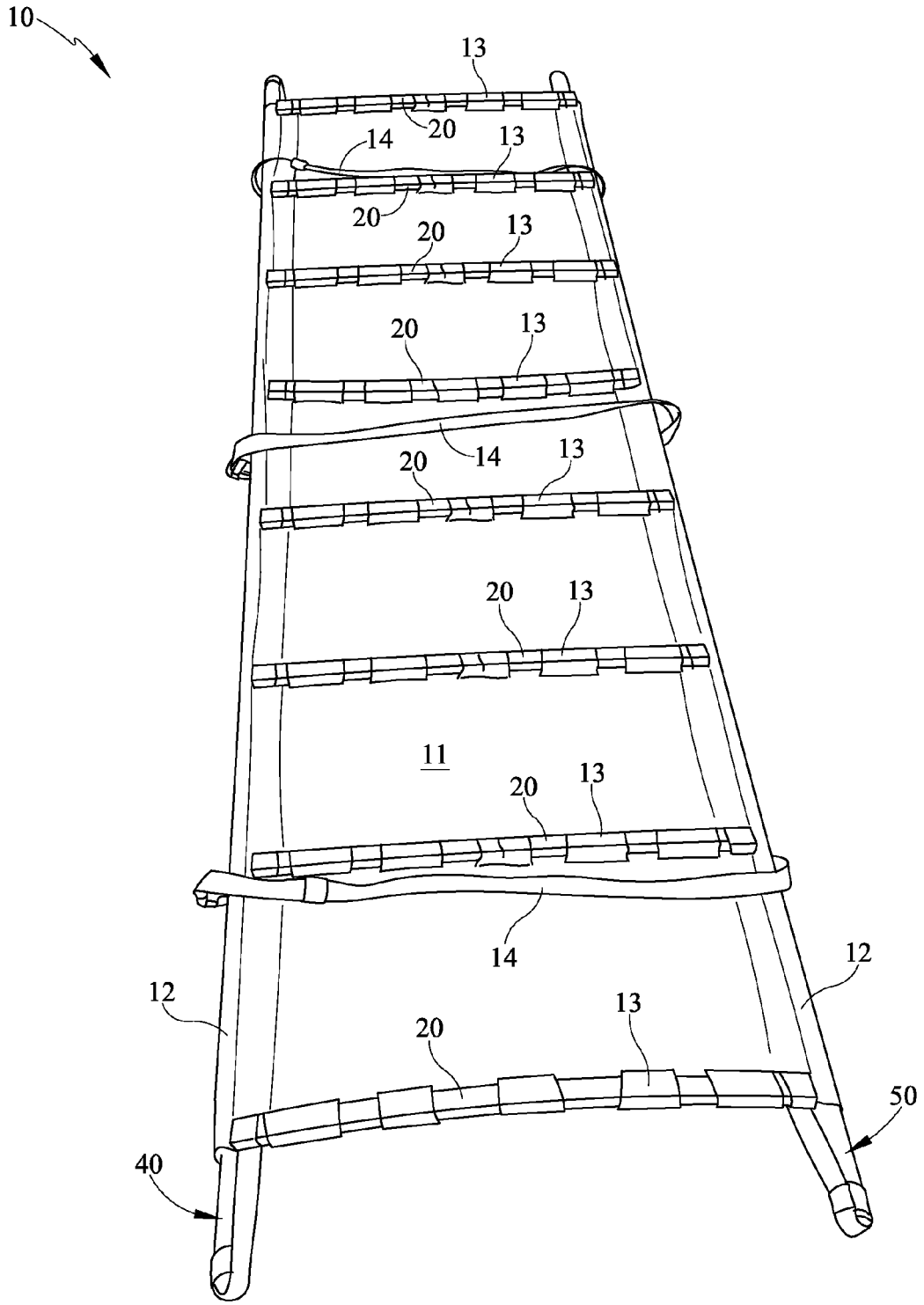
FIG. 5 is a perspective view of a bottom side of a rigid collapsible litter substantially in its deployed form in accordance with one embodiment of the present invention.
Figure 6:
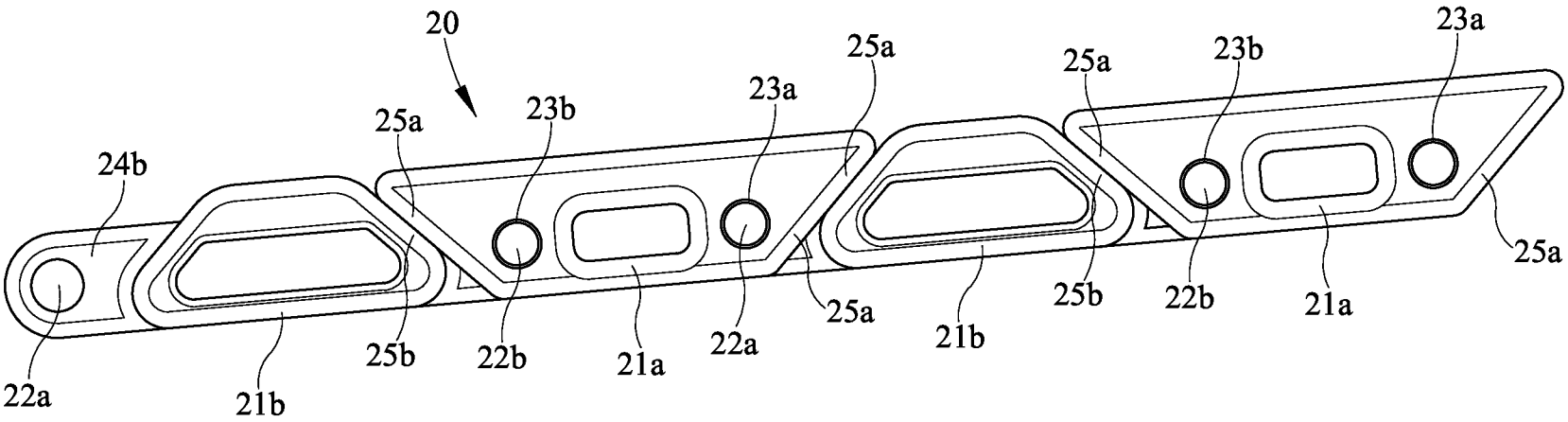
FIG. 6 is a front view of a section of a rigid collapsible rib in accordance with one embodiment of the present invention.
Figure 7:
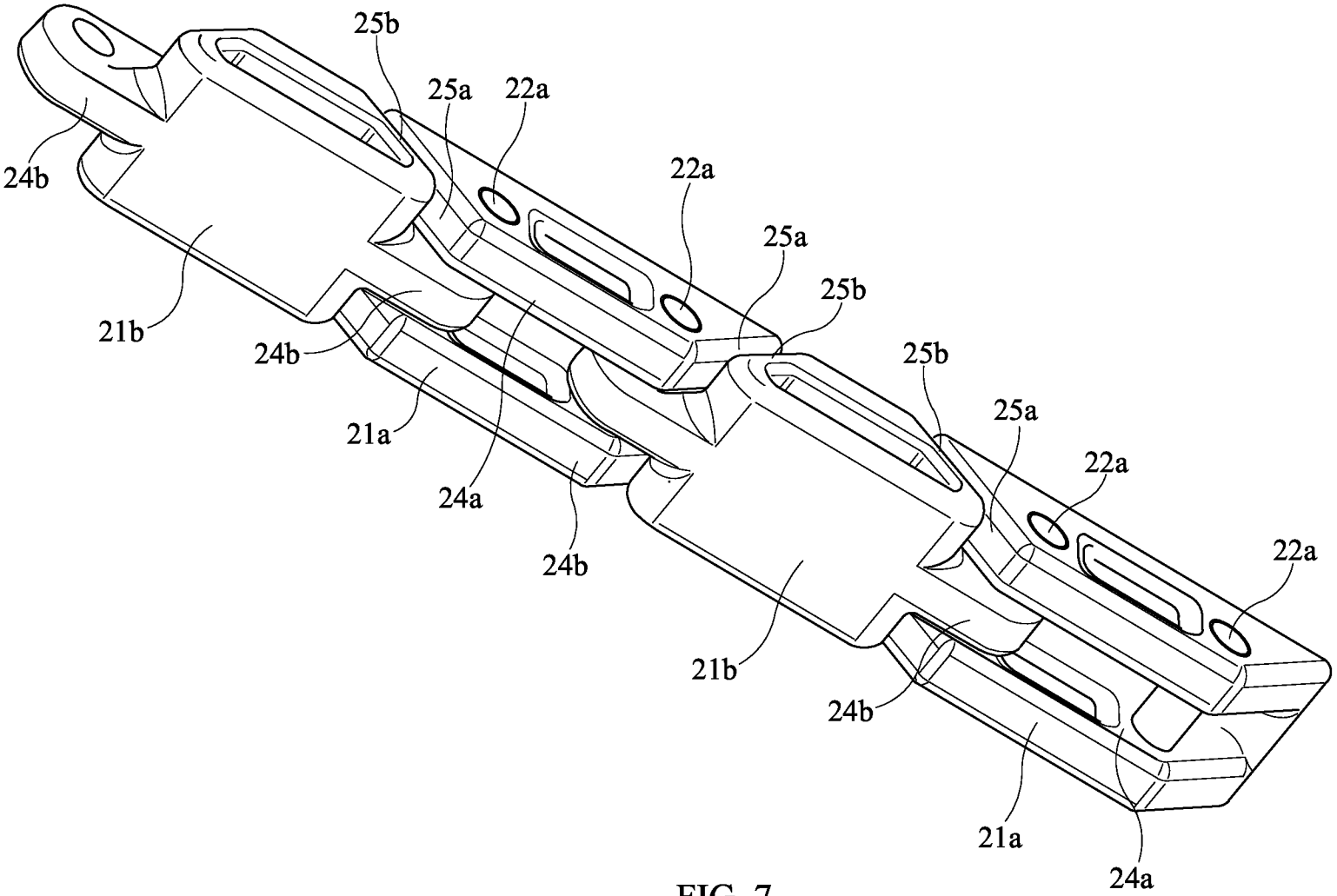
FIG. 7 is a perspective view of a section of a rigid collapsible rib in accordance with one embodiment of the present invention.
Figure 8:
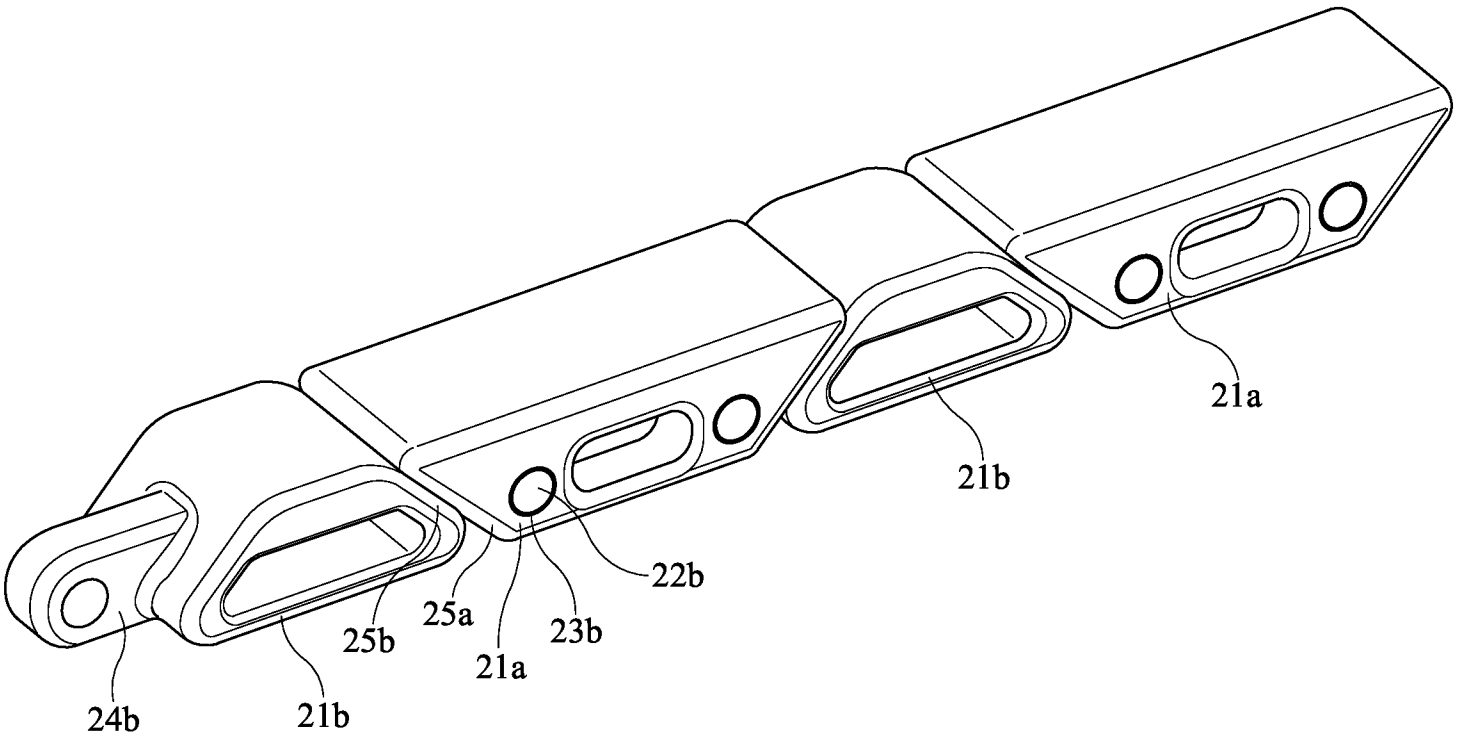
FIG. 8 is a perspective view of a section of a rigid collapsible rib in accordance with one embodiment of the present invention.
Figure 9C:
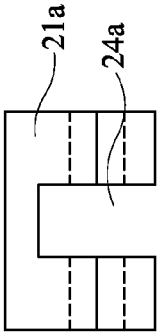
FIG. 9*c* is a view of a first link taken along the line 9*c*-9*c* of FIG. 9*b* in accordance with one embodiment of the present invention.
Figure 9D:
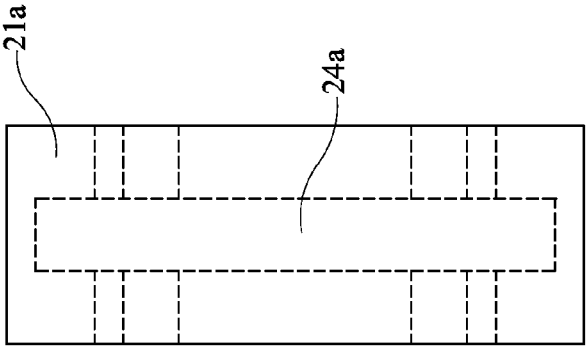
FIG. 9*d* is a view of a first link taken along the line 9*d*-9*d* of FIG. 9*b* in accordance with one embodiment of the present invention.
Figure 9B:
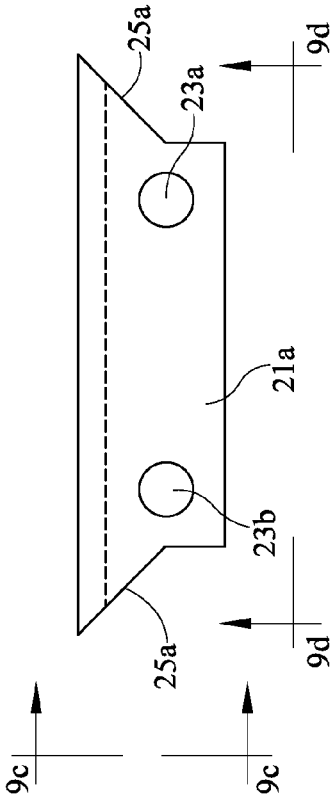
FIG. 9*b* is a side view of a first link of a rigid collapsible rib in accordance with one embodiment of the present invention.
Figure 9A:
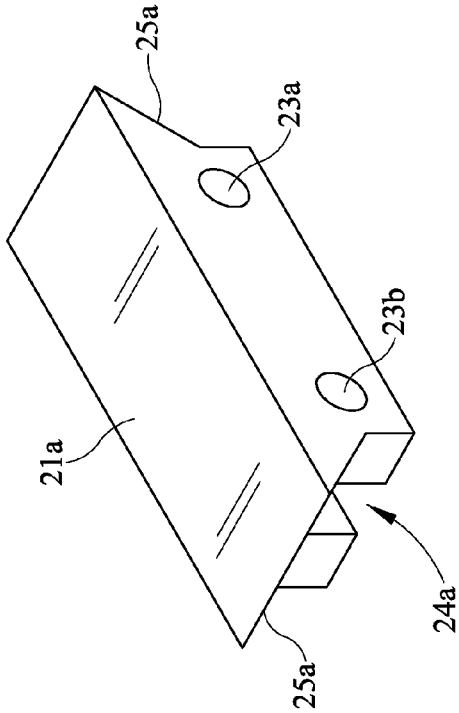
FIG. 9*a* is a perspective view of a first link of a rigid collapsible rib in accordance with one embodiment of the present invention.
Figure 10C:
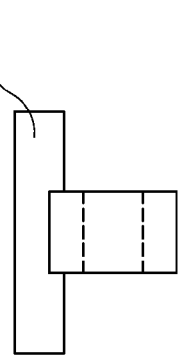
FIG. 10*c* is a view of a second link taken along the line 10*c*-10*c* of FIG. 10*b* in accordance with one embodiment of the present invention.
Figure 10D:
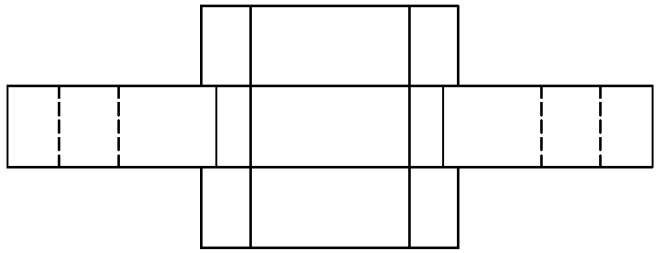
FIG. 10*d* is a view of a second link taken along the line 10*d*-10*d* of FIG. 10*b* in accordance with one embodiment of the present invention.
Figure 10B:
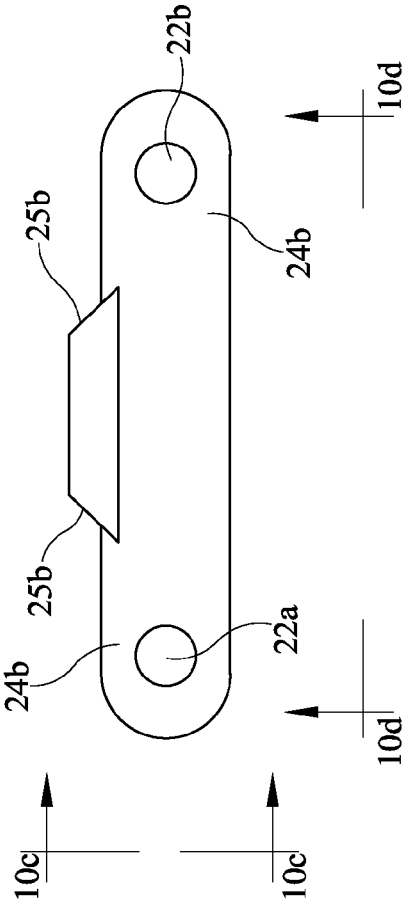
FIG. 10*b* is a side view of a second link of a rigid collapsible rib in accordance with one embodiment of the present invention.
Figure 10A:
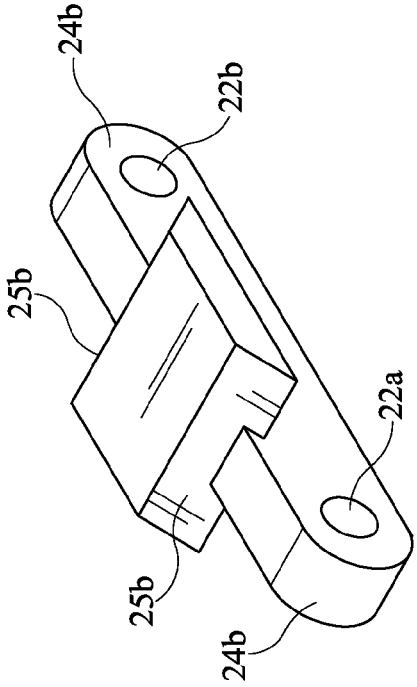
FIG. 10*a* is a perspective view of a second link of a rigid collapsible rib in accordance with one embodiment of the present invention.
Figure 11:
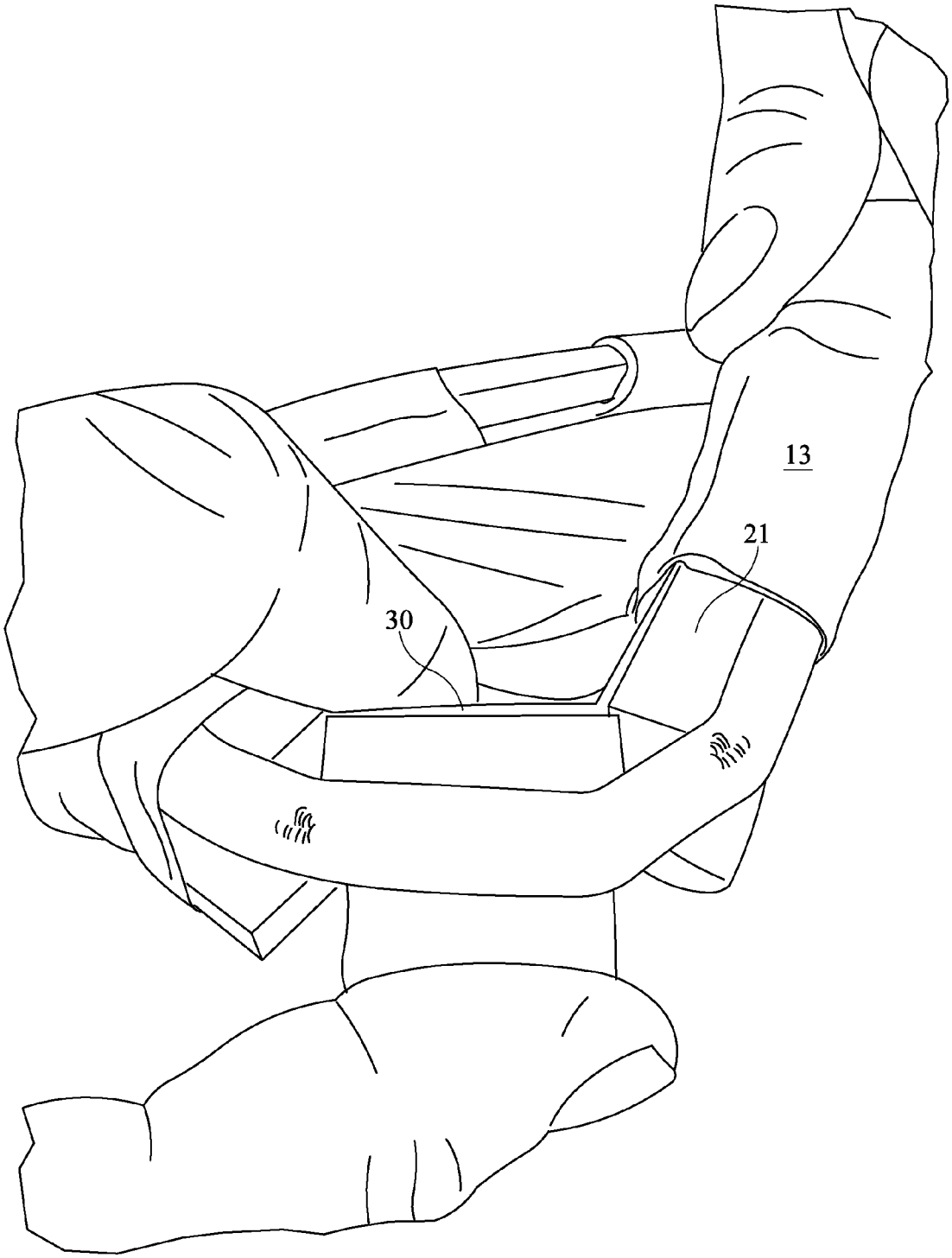
FIG. 11 is perspective view of a section of a rigid collapsible rib in accordance with one embodiment of the present invention.
Figure 12:
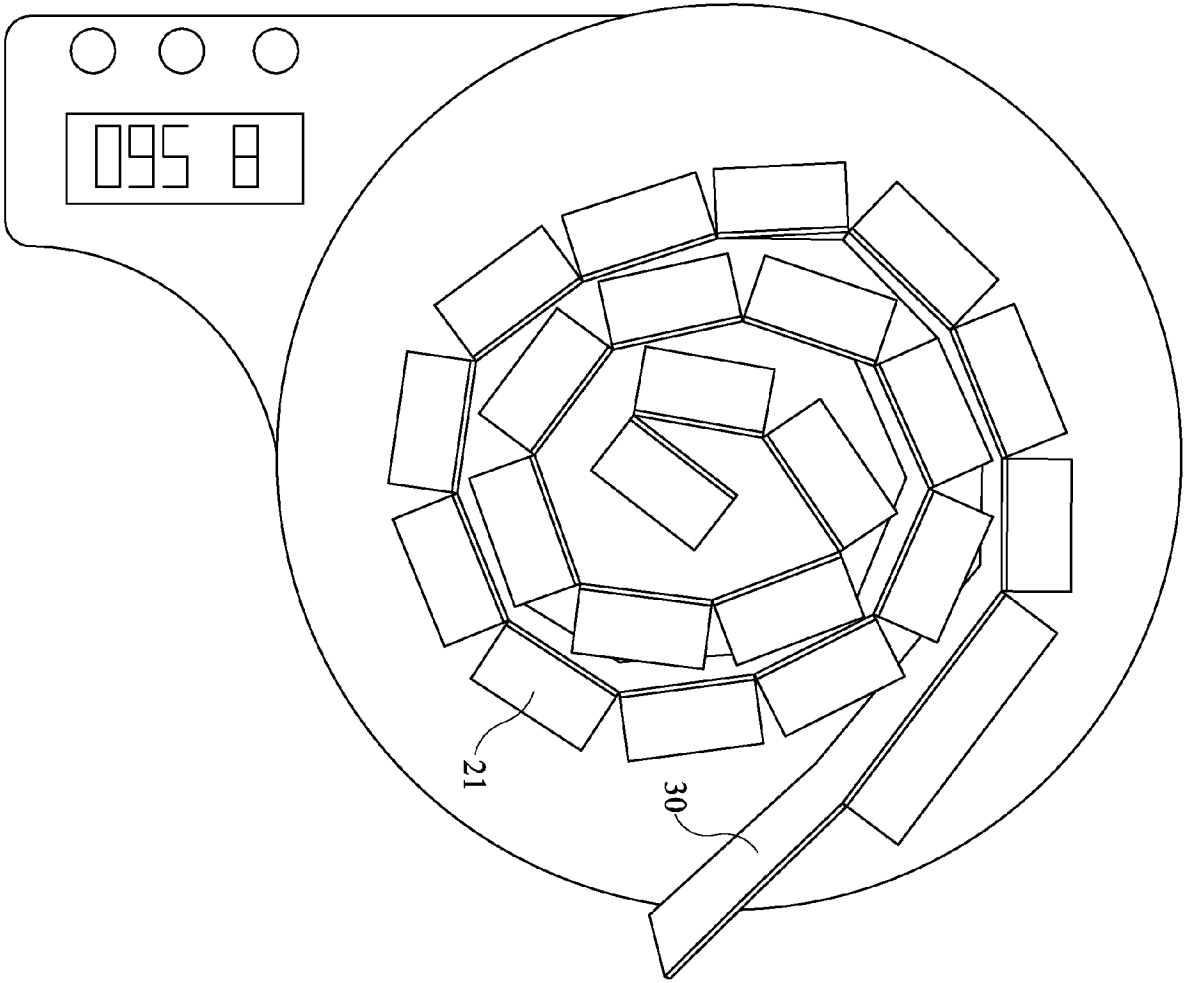
FIG. 12 is a top view of a rigid collapsible rib substantially in its compact form in accordance with one embodiment of the present invention.
Figure 13:
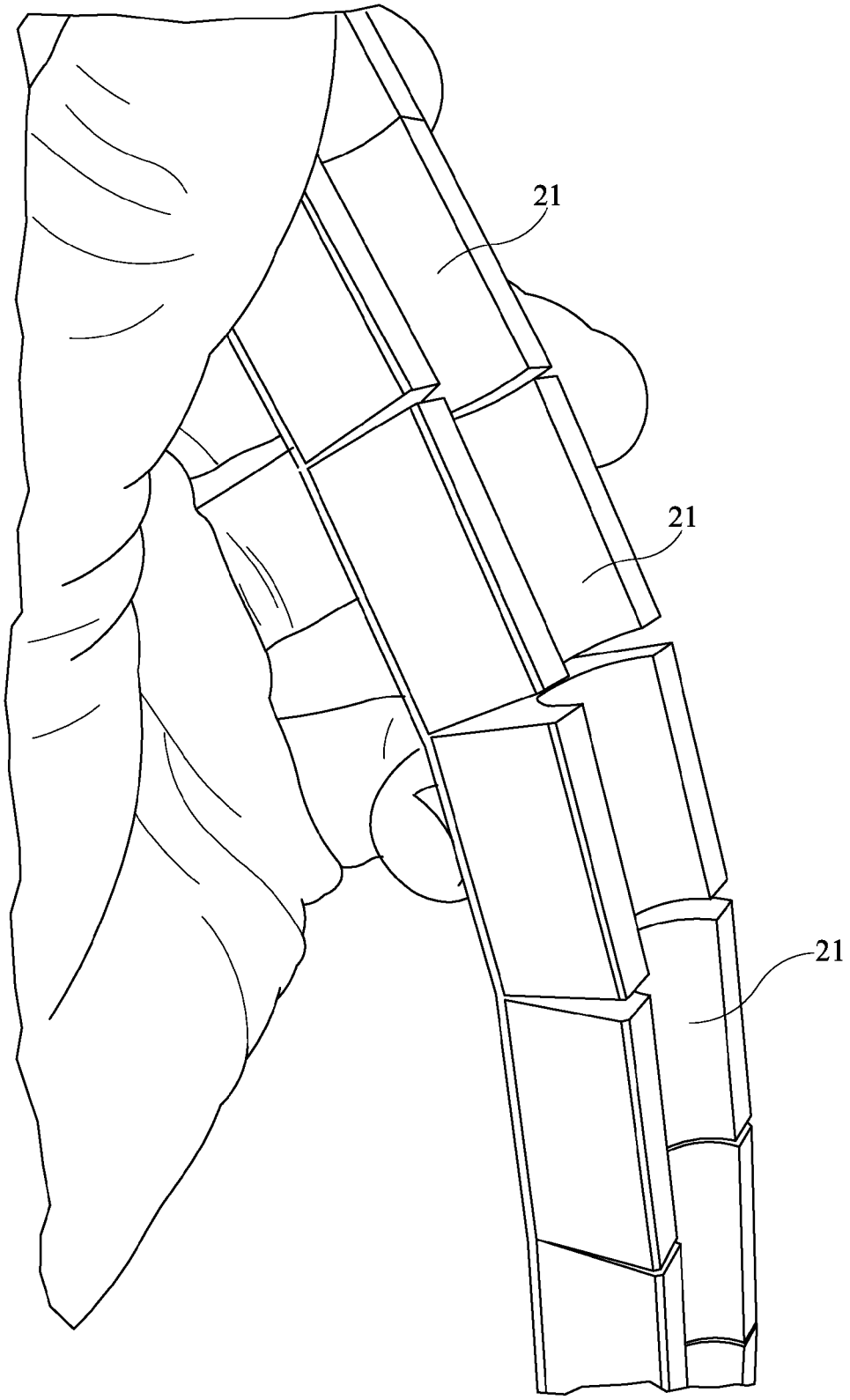
FIG. 13 is a perspective view of a section of a rigid collapsible rib in accordance with one embodiment of the present invention.
Figure 14:
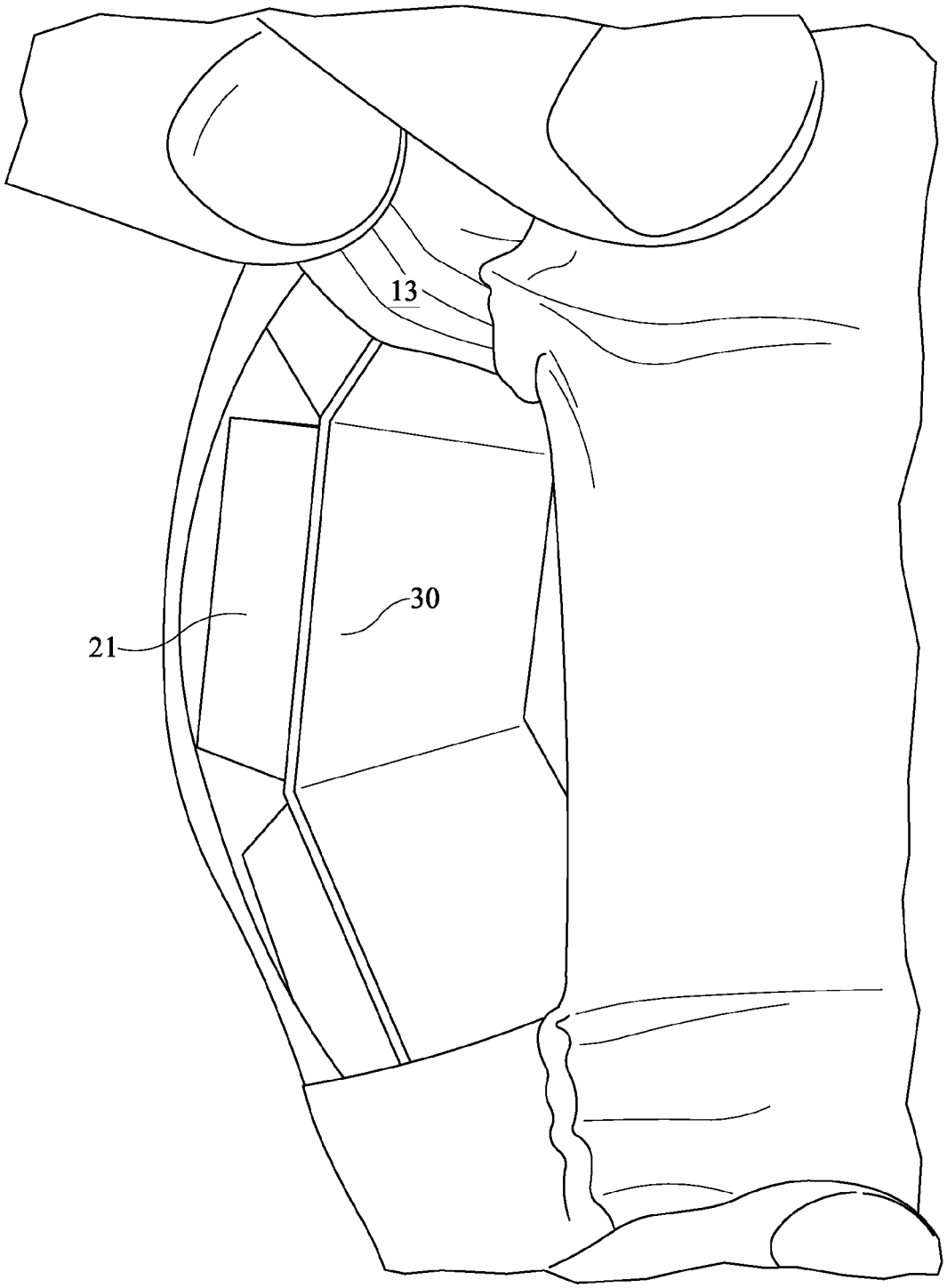
FIG. 14 is a perspective view of a section of a rigid collapsible rib in accordance with one embodiment of the present invention.

Referring now to FIGS. 1-5 and in accordance with a constructed embodiment of the present invention, illustrated is a rigid collapsible litter 10 having a base 11, handle sleeves 12, rib sleeves 13, straps 14, ribs 20, tensile strips 30, a first handle 40, and a second handle 50. In some embodiments, base 11 has attached thereto, or integral therewith, two handle sleeves 12, wherein each handle sleeve 12 is located on opposite sides of base 11, and each handle sleeve 12 runs substantially the length of base 11. In some embodiments, the handle sleeves 12 may be open on either one or both ends and thereby allow a first handle 40 or a second handle 50 to be inserted into, or through, it.

Base 11 has attached thereto, or integral therewith, a plurality of rib sleeves 13. In some embodiments, rib sleeves 13 may run the width of base 11, from side to side, transverse and/or perpendicular to handle sleeves 12. The rib sleeves may be sized and located to receive ribs 20 and thereby support a passenger and/or cargo by preventing handles 40, 50, or handle sleeves 12, from folding inwardly toward each other when the weight or other load is applied to base 11. In some embodiments of the present invention, rigid collapsible litter 10 may optionally have attached thereto, or integral therewith, one or more straps 14. Straps 14 may be used to secure a person, or passenger, to rigid collapsible litter 10 and/or facilitate in carrying rigid collapsible litter 10 and/or its passenger.

In some embodiments, base 11, handle sleeves 12, and/or rib sleeves 13 may be constructed of a pliable or flexible material capable of being rolled and/or folded. Examples of material that may be used for base 11, handle sleeves 12, and/or rib sleeves 13 include, but are not limited to, rip-stop parachute material, nylon, neoprene coated nylon, cotton, or any other flexible material capable of withstanding the weight of a person of a predetermined size. In some embodiments, it may be desirable that the material used for base 11, handle sleeves 12, and/or rib sleeves 13 be sufficiently durable to resist tearing, fraying, water, and other damaging events.

In some embodiments, first handle 40 and/or second handle 50 may be constructed of a lightweight material having sufficient integrity to support a passenger and/or cargo. In one embodiment of the invention, first and second handles 40, 50 may comprise combat carbon poles that are commonly used in military applications. Examples of materials that may be used to construct first and second handles 40, 50 include, but are not limited to, aluminum and carbon fiber. Handles 40, 50 may be solid or hollow, although in some embodiments it may be desirable to use hollow handles 40, 50 since they would likely be lighter in weight.

In some embodiments, ribs 20 are of a one-way collapsible design allowing a fully deployed rigid collapsible litter 10 to be made into its compact form, when desired, yet sufficiently resistant to yielding in the non-collapsible direction to support a passenger and/or cargo.

Referring now to FIGS. 6-10*d*, an embodiment of a section of rib 20 is depicted. The section of rib 20 depicted in FIGS. 6-8 contains a plurality of rib links 21*a*, 21*b*, which are depicted in more detail in FIGS. 9 and 10. A first rib link 21*a* and a second rib link 21*b* are depicted. First rib link 21*a* has a first pin hole 23*a* and a second pin hole 23*b*, designed to receive a first pin 22*a* and a second pin 22*b*, respectively. In this way, first pin 22*a* may be inserted into first pin hole 23*a* allowing rotation of first rib link 21*a* in relation to second rib link 21*b* about first pin 22*a*. Similarly, second pin 22*b* may be inserted into second pin hole 23*b* allowing rotation of first rib link 21*a* in relation to second rib link 21*b* about second pin 22*b*. First rib link 21*a* has a first lock face 25*a* and second rib link 21*b* has second lock face 25*b*. Lock faces 25*a*, 25*b* are located and adapted to act as a mechanical stop and/or prevent rotation of first rib link 21*a* in relation to the second rib link 21*b* about the pins 22*a*, 22*b* in one direction.

This construction permits ribs 20 to be collapsible in one direction, but not in the opposite direction. First rib link 21*a* is shown having a slot 24*a* adapted to accept insertion of a protrusion 24*b* of second link 21*b*, thus allowing alignment of pins 22*a*, 22*b* with respective pin holes 23*a*, 23*b*. It is understood that the dimensions listed on FIGS. 9 and 10 illustrate one embodiment, but the dimensions are not to be construed to limit the scope of this instant invention. It is understood that a variety of other dimensions and/or orientations may be used without departing from the scope of the invention.

Referring now to FIGS. 11-14, an embodiment of a section of rib 20 is depicted. The section of rib 20 depicted in FIGS. 11-14 contains a plurality of rib links 21 that have a tensile strip 30 secured thereto along a side, forming ribs 20 that may be inserted into rib sleeves 13. This embodiment provides for a one-way collapsible design by allowing rotation of rib links 21 in relation to one another about a point adjacent to tensile strip 30, such that, when collapsed, tensile strip 30 is nearest the center of an arc formed by rib 20. Tensile strip 30, however, prohibits collapsing of rib 20 in the direction opposite the collapsible direction, as such collapsing requires stretching of tensile strip 30.

In some embodiments, it may be desirable to use a material for tensile strip 30 that has sufficient tensile strength to resist collapsing in the non-collapsible direction when rigid collapsible litter 10 is loaded with a passenger and/or cargo. Tensile strip 30 material may include, but is not limited to, sail cloth, woven fabric, rope, flexible metals, plastic, rubber, nylon, polyester, Kevlar and any other material. Further, tensile strip 30 may be reinforced by inclusion of carbon fibers and/or any reinforcing material. It is understood that other embodiments may be used to achieve a one-way collapsible rib design.

Figure 15:
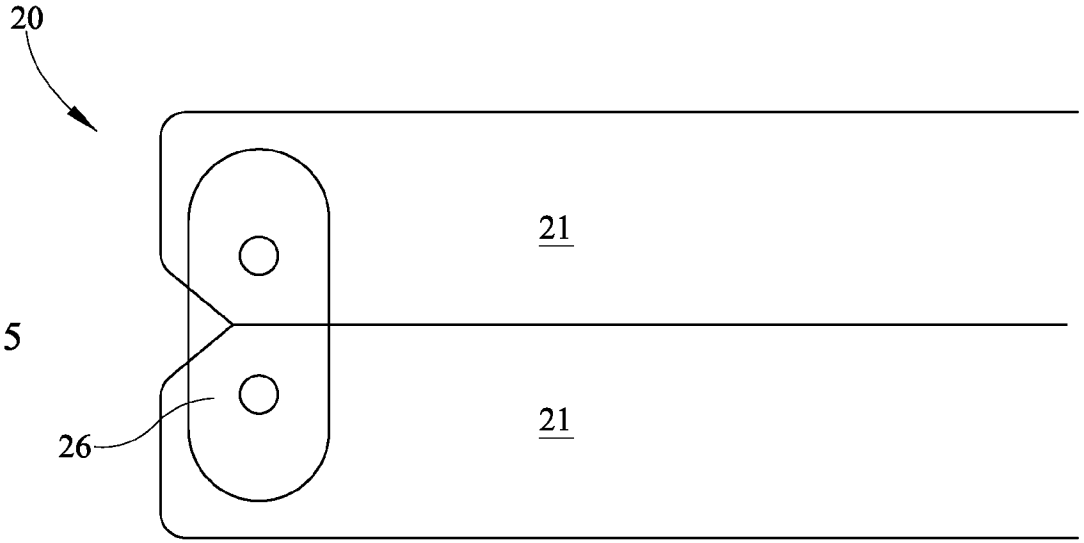
FIG. 15 is a drawing of a section of a rigid collapsible rib in accordance with one embodiment of the present invention.
Figure 16:
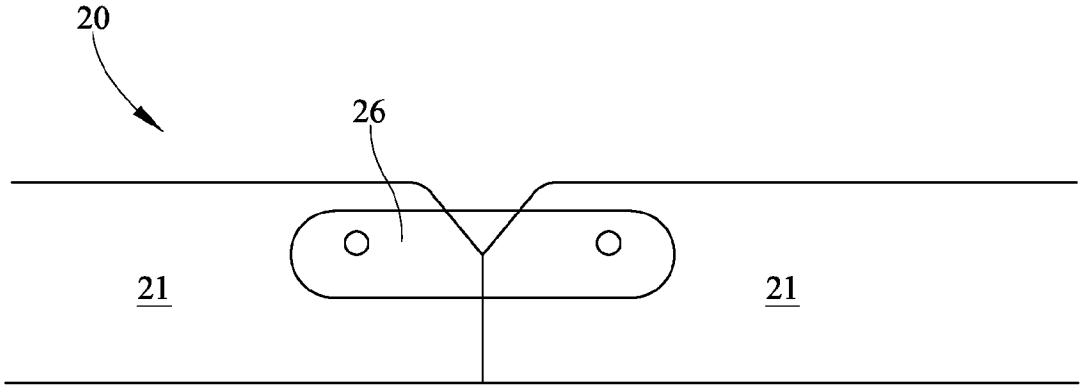
FIG. 16 is a drawing of a section of a rigid collapsible rib in accordance with one embodiment of the present invention.

Without limitation, other examples include use of a side clamp or hinge mechanism 26, located on one or more sides of rib links 21, which allow rotation in one direction but not in the opposite direction, such as a dual pin hinge mechanism 26 attached near adjacent ends of adjacent rib links 21. An embodiment in accordance with this example is illustrated in more detail in FIGS. 15 and 16. In this example, rib links 21 may be extended in a non-collapsible direction to form a substantially linear or arcuate rib 20, wherein the adjacent ends of rib links 21 eventually abut to form a mechanical stop that prevents further extension of rib 20 in that direction. Yet, in this example, rib links 21 may be rotated by use of the dual pin hinge mechanism 26 to be translated from an end-to-end orientation to a top-to-bottom orientation in the collapsible direction opposite the non-collapsible direction. It is understood that any number of rib links 21, 21*a*, 21*b* may be used to form ribs 20, and no numerical limitation is found herein.

Base 11, handle sleeves 12, rib sleeves 13, straps 14, ribs 20, tensile strip 30, first pole 40, and/or second pole 50 may be assembled in any combination to form a system for forming a rigid collapsible litter 10. Base 11, and/or handle sleeves 12, rib sleeves 13, and/or straps 14, may also be folded and/or rolled in virtually any direction to be compact and relatively lightweight, and thus easy to carry. Base 11 may be unrolled and unfolded to a field-ready, or deployed form for carrying a passenger or load. Ribs 20 may be compacted by rolling, folding, and/or otherwise compacting and may be inserted into rib sleeves 13. Ribs 20 may be inserted into rib sleeves 13 at any time, including before or after uncompacting of base 11. Ribs 20 may be straightened out or otherwise uncompacted in one direction until substantially straight or having a relatively shallow arc, as discussed herein, to provide a side-to-side support to prevent handles 40, 50 from approaching each other under a load, such as a passenger's weight. In this way, a rigid collapsible litter 10 system may be provided that is fit to carry a passenger or other load, but is also compactable when desired and/or relatively lightweight and easy to carry.

In some embodiments, a method of deploying a rigid collapsible litter 10 is provided. The method may comprise the steps of: unrolling base 11, having a plurality of rib sleeves 13 holding ribs 20 in a roll direction; unfolding base 11 in a fold direction transverse to said roll direction; inserting first handles 40 in a direction substantially parallel to said roll direction through handle sleeves 12; and moving a person onto base 11.

In some embodiments, the method may further include the steps of inserting a second handle 50 in a direction substantially parallel to said roll direction through a second handle sleeve 12 of base 11, and/or transporting the person from a first location to a second location.

The foregoing detailed description of the embodiments of the invention is presented primarily for clearness of understanding and no unnecessary limitations are to be understood or implied therefrom. Modifications to the present invention in its various embodiments will become obvious to those skilled in the art upon reading this disclosure and may be made without departing from scope of the invention and the claims appended hereto.

We claim:

1. A rigid collapsible litter comprising:

a foldable base having a first side and a second side;

at least one handle sleeve extending from said first side to said second side;

a plurality of rib sleeves integral with said foldable base and extending substantially across said foldable base, said plurality of rib sleeves extending in a direction substantially transverse to said at least one handle sleeve; and a plurality of ribs insertable into said one or more rib sleeves, said ribs each having a plurality of first and second rib links, said first rib links having first and second angled lock faces on opposed ends thereof, and a lower portion having a slot therein for accepting a protrusion extending from said second rib links, said slot having a pair of pin apertures extending therethrough, said second rib links having a pair of pin apertures therein complementary to the pin apertures of said first rib links, and complementary first and second angled lock faces on a central upper portion of said second rib links, whereby said first and second lock faces of said first rib links contact said complementary first and second lock faces of said second rib links to prohibit rotation of first and second rib links with respect to each other in one direction.

2. A rigid collapsible litter as claimed in claim 1 further comprising a tensile strip affixed to said ribs thereby allowing said ribs to be rolled in said first direction and prohibiting flexure of said ribs in said second direction beyond said extended position.

3. A rigid collapsible litter as claimed in claim 1 further comprising one or more clamps rotatably affixing each of said rib links to an adjacent one of said rib links, thereby allowing said ribs to be rolled in said first direction and prohibiting flexure of said ribs in said second direction beyond said extended position.

4. A rigid collapsible litter as claimed in claim 1 comprising:

a handle insertable in to said at least one handle sleeve.

5. A rigid collapsible litter as claimed in claim 1 further comprising one or more straps for securing a person to said rigid collapsible litter.

6. A rigid collapsible litter system comprising:

a flexible base having a pair of opposed handle sleeves and a plurality of rib sleeves transverse to said handle sleeves;

first and second handles insertable through said handle sleeves; and a plurality of collapsible ribs insertable into said rib sleeves, said ribs having a plurality of first and second rib links rotatably affixed to each other, said first rib links having a slot therein for accepting a protrusion extending from said second rib links and an upper portion having first and second angled locking faces on opposed ends thereof, said second rib links having complementary first and second angled locking faces on an upper central portion thereof, first and second rib links are rotatably affixed to each other allowing said ribs to be rolled in a first direction, and said first and second rib links including a mechanical stop to prohibit flexure of said ribs in a second direction.

* * * * *